US008001894B2

(12) United States Patent
Rauh

(10) Patent No.: US 8,001,894 B2
(45) Date of Patent: Aug. 23, 2011

(54) ROLLER OF A PRINTING MACHINE COMPRISING A DEVICE FOR GENERATING AN AXIAL OSCILLATING MOVEMENT OF THE ROTATING ROLLER

(75) Inventor: Volker Gerold Rauh, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 410 days.

(21) Appl. No.: 12/226,055

(22) PCT Filed: Apr. 27, 2007

(86) PCT No.: PCT/EP2007/054143

§ 371 (c)(1),
(2), (4) Date: Oct. 7, 2008

(87) PCT Pub. No.: WO2007/128709

PCT Pub. Date: Nov. 15, 2007

(65) Prior Publication Data

US 2009/0266253 A1 Oct. 29, 2009

(30) Foreign Application Priority Data

May 10, 2006 (DE) ..... 10 2006 021 749

(51) Int. Cl.
*B41F 31/15* (2006.01)

(52) U.S. Cl. ..... 101/350.3; 101/DIG. 38; 101/352.06; 492/18

(58) Field of Classification Search ..... 101/DIG. 38, 101/350.3, 352.06, 348; 492/15, 18, 16, 492/60

See application file for complete search history.

(56) References Cited

U.S. PATENT DOCUMENTS

| | | | | | |
|---|---|---|---|---|---|
| 2,697,983 | A * | 12/1954 | Taylor | 101/348 |
| 3,179,047 | A * | 4/1965 | Ordway | 101/348 |
| 4,337,699 | A | 7/1982 | Beisel | |
| 5,062,362 | A * | 11/1991 | Kemp | 101/348 |
| 5,125,340 | A | 6/1992 | Moore | |
| 5,134,939 | A | 8/1992 | Borne | |
| 5,201,270 | A * | 4/1993 | Dorsam et al. | 101/348 |
| 5,329,851 | A | 7/1994 | Momot | |
| 6,543,355 | B1 * | 4/2003 | Stiel | 101/248 |
| 6,772,685 | B2 * | 8/2004 | Schaffrath | 101/352.06 |
| 7,131,377 | B2 | 11/2006 | Schaffrath | |

FOREIGN PATENT DOCUMENTS

| | | |
|---|---|---|
| DE | 2 235 313 | 2/1973 |
| DE | 2 238 481 | 2/1974 |
| DE | 29 31 141 C3 | 2/1981 |
| DE | 36 20 423 A1 | 12/1987 |
| DE | 196 03 765 A1 | 8/1997 |
| DE | 102 27 516 A1 | 5/2003 |
| DE | 10 2004 057 817 | 7/2005 |
| DE | 10 2005 019 266 | 12/2005 |
| EP | 0 363 228 A2 | 4/1990 |
| EP | 0 453 847 A1 | 10/1991 |
| EP | 0 476 379 A1 | 3/1992 |

* cited by examiner

*Primary Examiner* — Judy Nguyen
*Assistant Examiner* — Leo Hinze
(74) *Attorney, Agent, or Firm* — Jones, Tullar & Cooper, P.C.

(57) ABSTRACT

A roller of a printing machine includes a device for use in the generation of an axial oscillating movement of the rotating roller. The device includes a drive that is comprised of a pump which pressurizes a working fluid. The pump is arranged inside of the roller.

46 Claims, 3 Drawing Sheets

ROLLER OF A PRINTING MACHINE COMPRISING A DEVICE FOR GENERATING AN AXIAL OSCILLATING MOVEMENT OF THE ROTATING ROLLER

CROSS REFERENCE TO RELATED APPLICATIONS

This application is the U.S. national phase, under 35 USC 371, of PCT/EP2007/054143, filed Apr. 27, 2007; published as WO 2007/128709 A2 and A3 on Nov. 15, 2007 and claiming priority to DE 10 2006 021 749.7, filed May 10, 2006, the disclosures of which are expressly incorporated herein by reference.

FIELD OF THE INVENTION

The present invention is directed to a roller for a printing press and comprising a device for generating an axial oscillating movement of the rotating roller. A drive is used to generate the axial oscillating movement of the rotating roller. The drive includes a pump device which places a working fluid under pressure.

BACKGROUND OF THE INVENTION

The present invention is directed primarily to devices for generating an axial oscillating movement for use with oscillating rollers of an inking unit or a dampening unit of a printing press. Such rollers are generally rotated through frictional contact with an adjacent roller or with an adjacent cylinder, which is, in turn, driven either directly or indirectly through the machine drive for the associated printing press.

A device for the axial reciprocating movement of an oscillating roller is known from DE 196 03 765 A1. An external power source, particularly in the form of a piston/cylinder unit, is provided for the accomplishment of the reciprocating movement. According to one preferred embodiment of that prior device, the oscillating roller can be equipped, in its interior, with two pressure chambers. A differential pressurization of these two pressure chambers causes the reciprocating movement of the oscillating roller. In this device, compressed air is provided as the working medium, which compressed air is generated by an external compressor.

Another device, for use in generating axial movements of the oscillating rollers of inking and dampening units of printing presses, is known from the disclosure of DE-OS 2 235 313. In this prior device, an external, dual-action cylinder is provided, whose piston forms one arm of the oscillating roller. Hydraulic oil, which is used as the working fluid, is supplied alternatingly to the pressure chambers of the cylinder through an external hydraulic drive and an external switchover valve. The hydraulic oil is stored in an external oil reservoir.

A self-oscillating roller assembly is known from U.S. Pat. No. 5,329,851 A. A working fluid is supplied alternatingly to pressure chambers, which act in opposite directions. The working fluid is provided from an external compressed air source through a timer-controlled, external switchover valve.

In contrast to the motor-actuated roller drives, which are described above, it is also known to provide a purely mechanical, self-actuating drive for imparting axial oscillating movement. In this connection, see, for example, DE 29 31 141 C3. The device which is disclosed in DE 29 31 141 C3 is actuated via the rotational movement of the roller shell. The oscillating movement of the roller is being generated through a ball and a bushing. The bushing is seated so as to be non-rotatable and has a groove which is skewed or angled. Between that groove and a second groove, which extends perpendicular to the center axis of the oscillating roller, the ball rolls in a bushing which is stationarily positioned in the roller shell. With rollers of this type having mechanical friction drives, there is a danger of the rollers becoming locked, which roller locking can lead to serious consequential damage. Moreover, it is not possible to vary the oscillation frequency, which frequency is permanently established by the structural conditions that exist in the particular roller.

DE 36 20 423 A1 describes various embodiments of drives for use in imparting axial movement to oscillating rollers. In one embodiment of this prior device, the roller is moved by the use of a pneumatic system. The pneumatic medium supply is located outside of the roller. In another embodiment of this prior device, axial movement is generated through the use of a mechanical transmission.

DE 10 2005 019 266 A1 discloses a drive for an inking roller of a printing press. The drive comprises a hydraulically actuable lift cylinder, which displaces the roller in an axial direction in an oscillating fashion. The requisite pneumatic medium for the hydraulically actuable lift cylinder is supplied via a pump.

SUMMARY OF THE INVENTION

The object of the present invention is to provide a roller for a printing press which includes a device for generating an axial oscillating movement of the rotating roller.

This object is attained according to the present invention through the provision of the device for generating an axial movement of the rotating roller in the form of a drive that includes a pump. The pump places a working fluid under pressure and is located inside the roller which is being provided with the axial oscillating movement.

The benefits to be achieved in accordance with the present invention consist, in particular, that a fully autonomous roller or oscillating roller is provided, which roller is not dependent upon supplemental supply and/or control components. Nevertheless, generally known mechanical transmissions, which have the disadvantages that have been described in detail above, need not be used for provision of the axial actuation of the roller.

It is particularly advantageous for the motorized drive for the axially oscillating roller to be situated completely inside the roller. This makes the structure particularly compact, and also serves to protect the drive and/or its components from damage.

In principle, the drive power for the axial oscillation of the roller can be derived in a variety of ways from the rotation of the roller and especially can be obtained, for example, through magnetic or electromagnetic means. Preferably, however, it is provided, in accordance with the present invention, that the motorized drive for the roller axial oscillation comprises a drive wheel. The drive wheel is preferably situated inside the roller and can be driven by the rotating roller, to which it can be connected in either a non-positive fashion or a positive fashion. Specifically, it is preferable that the drive wheel be drive connected to a cylindrical roller shell of the roller.

In principle, the axial oscillating movement of the roller could also be produced in a variety of ways, such as, for example, through the provision of an electromagnetic drive and a suitable transmission. However, in accordance with the present invention, it is preferable for the oscillating movement of the roller to be produced through a alternating supply of a working fluid to pressure chambers, each of which pressure chambers is acting in an opposite axial direction. The pressure chambers can be formed by a dual-action cylinder, which is situated inside the roller, either as a separate component or defined, for example, by the interior walls of the roller shell.

In accordance with a particularly preferred feature of the present invention, the motorized drive for accomplishing the axial oscillating movement of the roller comprises a pump device which places the working fluid under working pressure. The pump device is connected to the drive wheel and is therefore actuated by that drive wheel. This pump device is also preferably situated inside the roller.

A switchover value is preferably provided for accomplishing the alternating supply of working fluid to one or the other pressure chamber of the roller. This switchover valve is also preferably situated inside the roller.

The motorized drive can operate preferably hydraulically, or optionally can operate pneumatically. In the case of a hydraulic drive, a reservoir for hydraulic fluid can be provided, which reservoir is preferably also situated inside the roller. Such an internal reservoir can preferably be connected to the pump device through the switchover valve. In the case of a pneumatic drive, air can preferably be used as the working fluid.

The fundamental structure of the roller or the oscillating roller could, for example, be such that the roller has a cylindrical roller shell, which cylindrical roller shell is rotatably mounted on a non-rotatable shaft, which non-rotatable shaft is mounted so as to be displaceable in the axial direction. Preferably, however, the structure is such that the roller has a cylindrical roller shell, which cylindrical roller shell is capable of rotating relative to a stationary shaft. In this preferred embodiment the cylindrical roller shell is also mounted so as to be displaceable, in a reciprocating fashion, along the stationary shaft through the use of a slide mechanism. The slide mechanism is mounted so as to be incapable of rotating on the stationary shaft, but is displaceable in the axial direction of the stationary shaft.

With this type of structure, the arrangement of the individual drive components inside the roller is preferably such that the cylinder/piston assembly operates between the shaft and the slide mechanism. The pump device, along with the drive wheel and, if applicable, the reservoir, is preferably attached to the stationary shaft. Optionally, these mechanisms can also be attached to the slide mechanism. The switchover valve is preferably positioned on the stationary shaft or, if applicable, it can also be positioned on the slide mechanism. The switchover valve can be positioned in such a way that it can be switched based upon a relative movement between the stationary shaft and the slide mechanism.

The device for generating an axial oscillating movement of a rotating roller, in accordance with the present invention, enables a compact and sturdy construction for a motor-driven oscillating roller, which can be economically produced and which requires no external drive components of any kind. The risk of damage, especially with respect to consequential damage that may be caused by a locking roller, is comparatively low. Because of the provision of a pressure limit for the pump device, automatic overload protection is also provided.

The present invention provides increased flexibility. Variable length oscillating strokes can be achieved by changing the stop position of the switchover valve. An optionally adjustable delivery rate of the pump device determines the oscillation frequency of the roller. Moreover, the drive in accordance with the present invention can be easily adapted to different roller dimensions.

BRIEF DESCRIPTION OF THE DRAWINGS

A preferred embodiment of the present invention is represented in the accompanying drawings and will be described in greater detail in what follows.

The drawings show in.

DESCRIPTION OF THE PREFERRED EMBODIMENT

Figure 1:
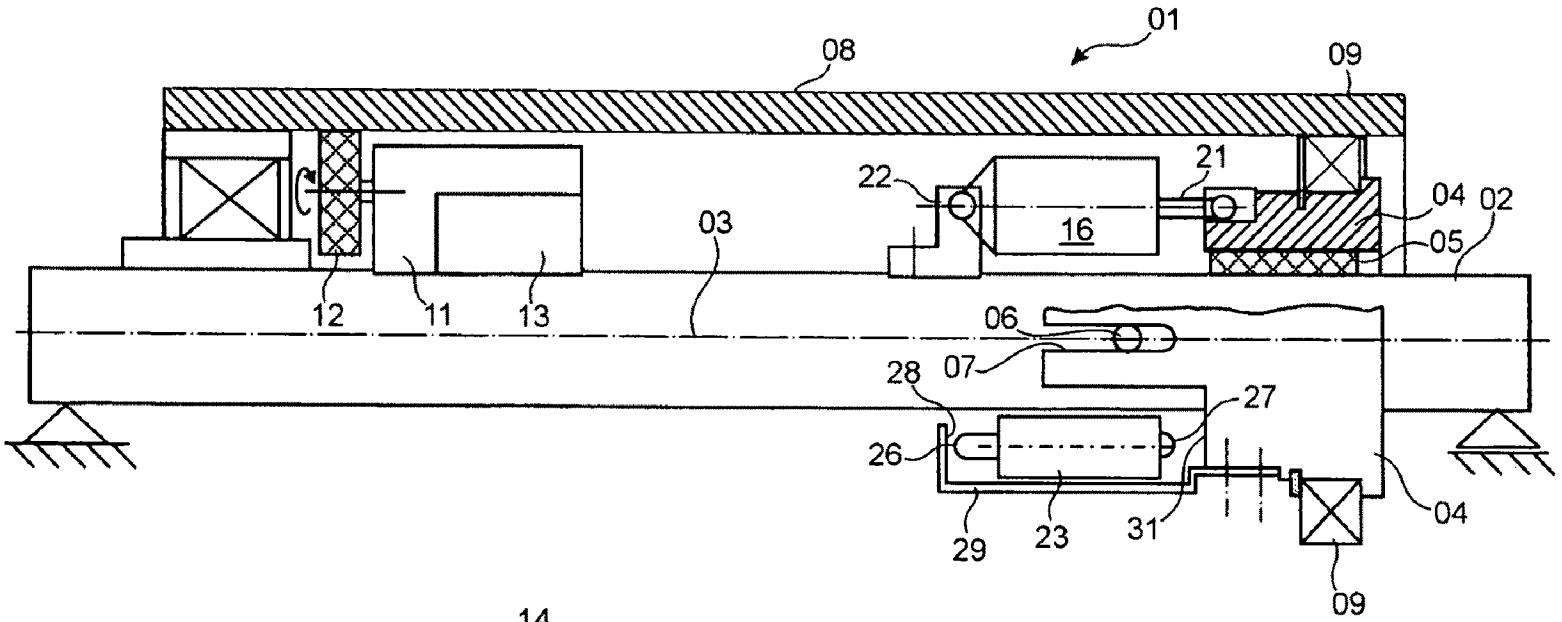
FIG. 1 a partially cross-sectional and schematic side view of a roller with an internal motorized drive in accordance with the present invention, and wherein, in order to improve the clarity of the drawing, unnecessary parts of the assembly have been omitted, in FIG. 2 a schematic representation of the hydraulic system for the drive in accordance with FIG. 1, in FIG. 3 a preferred embodiment of a pump inside a roller in accordance with the present invention, and in FIG. 4 a printing unit of a printing press.

Referring initially to FIG. 1, there may be seen, generally at 01, a roller in accordance with the present invention.

The roller 01 of the present invention, and according to the specified and represented preferred embodiment, may be, for example, an oscillating roller 01 of an inking unit or of a dampening unit of a printing press, which is not illustrated in greater detail. As seen in FIG. 1, roller comprises a stationary shaft 02 having a shaft axis 03. A slide mechanism 04 is capable of being displaced on the shaft 02, in the direction of the shaft axis 03, via appropriate slide or linear bearings 05. Slide mechanism 04 is secured or locked against rotation. This securement or locking of slide mechanism 04 against rotation is indicated in FIG. 1 by a pin 06, which is fastened in the shaft 02 and which is received in, and engages in an elongated hole 07 or in a slot 07 in the slide mechanism 04. It will be understood that the locking of the slide mechanism 04 against rotation could also be ensured in another manner. For example, the stationary shaft 02 could be provided with a polygonal, cross-section and a correspondingly adjusted guiding cross-section of the slide mechanism 04 or the bearing 05 could also be provided. The important feature is that the shaft 02 be stationary and that the slide mechanism 04 be movable axially with respect to the shaft 02 but not be rotatable with respect to the shaft 02.

A cylindrical roller shell 08, which is provided as the outer surface of the axially oscillatory roller 01, is mounted on the slide mechanism 04 through the use of bearing 09 so as to permit free rotation of that roller shell 08 in both rotational directions of the roller 01. The roller shell 08 of the roller 01 is therefore mounted so as to be both rotatable around the axis 03 of the stationary shaft 02 and displaceable along the axis 03 of the stationary shaft 02. During operation, the roller 01 or the oscillating roller 01 can rest against, and can engage the surface of, an adjacent roller which is rotationally driven during operation, or can rest against or can engage against the surface of a rotationally driven cylinder, neither of which is depicted in FIG. 1, which adjacent roller or cylinder can place roller 01 in rotation.

A device, as will now be described, is provided for moving the roller 01 in a reciprocating fashion during its rotation. In other words, the device, in accordance with the present invention, is provided for simultaneously imparting an axial oscillating movement to the roller 01, for example, in order to achieve an even distribution of printing ink.

Figure 3:
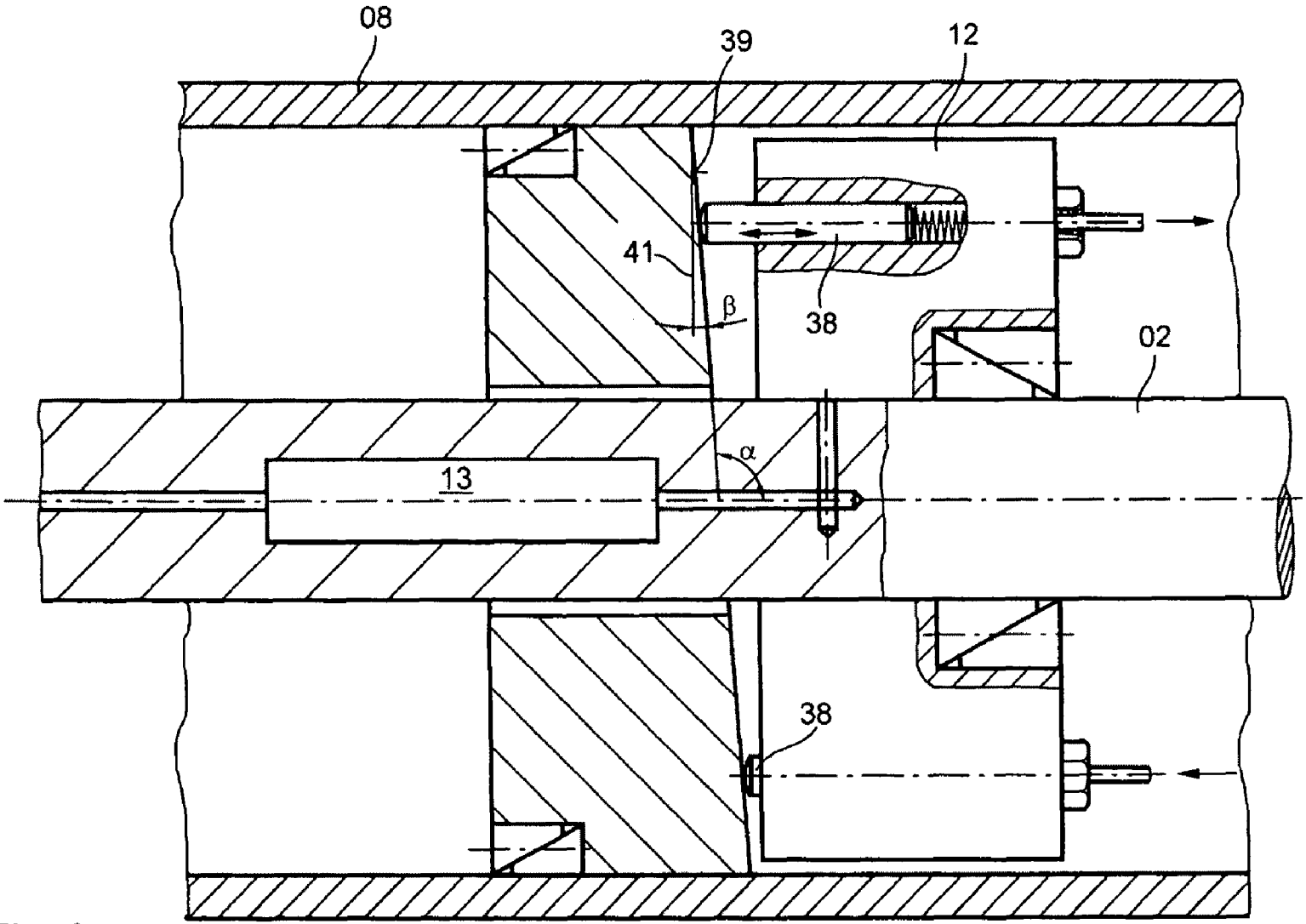

A pump device 11, namely a pump 11, and particularly a miniature pump 11 for hydraulic fluid, is attached to the fixed or stationary shaft 02. As may be seen in FIG. 1, pump 11 is driven by a pump drive wheel 12, the outer periphery of which pump drive wheel 12 rests against an interior surface of the roller shell 08, which roller shell interior surface is capable of driving pump drive wheel 12 in a non-positive manner. The pump 11 operates independently of the direction of rotation of the pump drive wheel 12, or the direction of rotation of the roller shell 08. A reservoir for hydraulic fluid is identified by the reference symbol 13, and is also attached to the stationary shaft 02. Hydraulic fluid reservoir 13 can share a housing with the pump 11, as seen in FIG. 1, or it can be situated outside of the housing, for example in the stationary shaft 02, as seen in FIG. 3.

Figure 2:
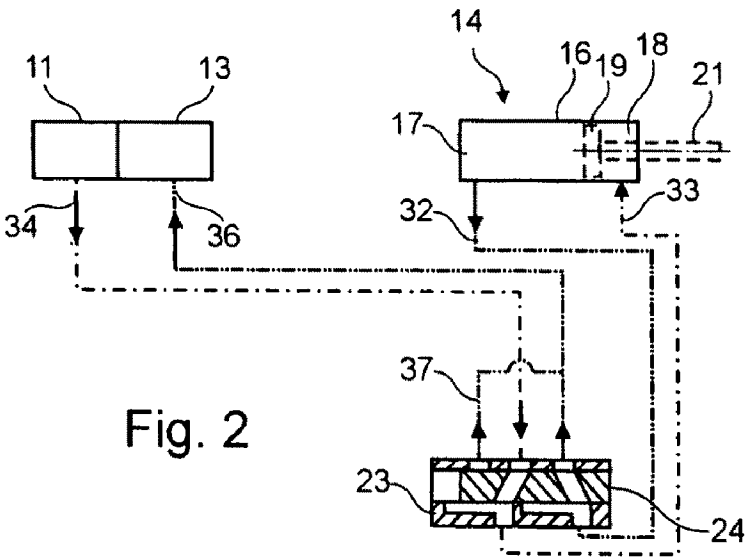

A cylinder/piston assembly 14 is depicted in FIG. 2 and comprises a dual-action cylinder 16 with two pressure chambers 17 and 18, which are separated from one another by a piston 19, with each pressure chamber 17; 18 having a port for a hydraulic line 32 or 33. One end of the cylinder 16 is connected, via an angled support 22, to the stationary shaft 02. At the opposite end of the cylinder 16, a piston rod 21, which is allocated to the piston 19, emerges from the cylinder 16 and is attached to the slide mechanism 04.

The cylinder/piston assembly 14 is positioned such that the functioning of the cylinder/piston assembly 14 allows the pump device 11 to generate an oscillating movement of the cylindrical roller shell 08 in the axial direction of a longitudinal axis of the roller 01.

When the piston 19 of the cylinder 16, which cylinder 16 is attached to the stationary shaft 02, executes an oscillating movement, this oscillating movement of piston 19, which oscillating movement of piston 19 extends parallel to the axis 03 of the stationary shaft 02, is transmitted, by the piston rod 21 to the slide mechanism 04. From the slide mechanism, the oscillating movement of the piston rod 21 is transmitted to the rotating roller shell 08, which roller shell 08 is rotatably mounted on the slide mechanism 04. The result is the generation of an axially oscillating movement of the roller shell 08 in response to a movement of the piston 19 back and forth in the dual-action cylinder 16.

To place the piston 19 of the cylinder/piston assembly 14 in an oscillating, or in other words, in a reciprocating, movement, hydraulic fluid is alternatingly supplied to the two pressure chambers 17, 18 of the dual-action cylinder 16. This alternating supply of hydraulic fluid to chamber 17; 18 is controlled through the provision of a switchover valve 23. The valve 23, in the case of the depicted preferred embodiment, is also attached to the stationary shaft 02. The switchover valve 23 is configured, for example, as a directional valve 23, as may be seen in FIG. 2, and comprises a center, displaceable switching section 24, which can be moved between two functional positions. To accomplish movement of this displaceable switching section 24, during the axial displacement of the slide mechanism 04, at the respective end sections of the axial displacement path, one protruding end 26 of the switching section 24 engages with a stop surface 28 of an angled stop 29, which angled stop 29 is attached to the slide mechanism 04. At its other protruding end 27, the displaceable switching section 24 engages with an opposite stop surface 31 of the slide mechanism 04.

The switchover valve 23 can also be configured as a pressure valve, which pressure valve 23 can be controlled based upon the pressure existing in the pressure chambers 17, 18 of the cylinder 16.

As is apparent from a review of the depiction of the switchover valve depicted in FIG. 2, the switchover valve 23 has three fluid intakes on one side and two fluid intakes on the other side, which fluid intakes can be connected to one another in various combinations through the two channels that are provided in the movable switching section 24. This connection of the various intakes can be accomplished by moving the switching section 24. Depending upon the position of the switching section 24, the pump 11 can selectively apply hydraulic fluid to the pressure chamber 18 of the dual-action cylinder 16 via the hydraulic lines 34, 33, as shown in FIG. 2. When the switching section 24 is in its other position, which is not specifically shown in FIG. 2, it can apply hydraulic fluid to the pressure chamber 17 via the hydraulic lines 34 and 32. The respective other pressure chamber 17 or 18, which is not connected to the pump 11, is connected to the reservoir 13 by the hydraulic lines 32 and 36, as is shown in FIG. 2 or via the lines 33, 37 and 36, when the switching section 24 is in the other position, which is not specifically shown in FIG. 2.

When the slide mechanism 04 is in either one of its end positions, which end positions are optionally defined by appropriate stops and which end positions are also optionally adjustable, the switchover valve 23 is used to switch the working direction of the cylinder/piston assembly 14. An immobilization mechanism, such as, for example, a detent mechanism, for example a detent mechanism employing a ball, can also be provided. With the use of such a detent mechanism, a neutral position, in which the two working directions block one another, is excluded.

In accordance with the present invention, the motorized drive 11; 12; 14; 23, which comprises specifically the pump 11; the pump drive wheel 12; the cylinder/piston assembly 14 and the switchover valve 23, draws its motive power for providing axial oscillating movement of the roller 01 from the rotation of the roller 01 or from the rotation of the roller shell 08. In accordance with the above-described preferred embodiment, the motorized drive 11; 12; 14; 23 is housed entirely inside the roller 01.

In an alternative preferred embodiment of the present invention, which is not specifically shown here, a pneumatic system may be provided in place of the above-described hydraulic system, in which air under pressure can preferably be used as the working fluid. In this alternative preferred embodiment, a reservoir for the working fluid would be superfluous.

In accordance with a further preferred embodiment of the present invention, which is also not specifically shown here, compressed air can also optionally be supplied from the outside through corresponding bore holes in the stationary shaft 02 via a push-lock connection.

In accordance with yet a further preferred embodiment of the present invention, which also is not shown here, the pump device 11 can also be mounted externally, such as, for example, outside of the roller shell 08 on the stationary shaft 02. In this embodiment, the supply lines can be conducted through the stationary shaft 02 into the interior of the roller 01. The dual-action cylinder 16 could also be mounted externally, as could either or both the reservoir 13 and the switchover valve 23. Positioning these components externally enables their optional shared use by a plurality of rollers. With an external arrangement of these components, any setting or subsequent adjustment of operating parameters is also simplified, such as, for example, the setting of a contact force or friction rate between the wheel 12 and the roller shell 08. It is also possible to control the friction rate or contact force independently of machine speed.

The pump 11 is preferably configured as an axial piston pump, which has at least one piston 38. Preferably, a plurality of such pistons 38 are arranged rotationally symmetrically in the axial piston pump 11, in relation to the shaft 02 of the roller 01. A longitudinal axis of each such piston 38 is preferably arranged parallel to the axis 03 of the shaft 02 or the axis of the roller 01. Such a pump 11 is depicted somewhat schematically in FIG. 3 as an additional preferred embodiment of the present invention.

The piston housing of the pump 11 is permanently attached to the shaft 02, preferably in a non-positive fashion, especially via a first clamp ring. Such a first clamp ring is depicted schematically as a wedge-like assembly situated in a shaft encircling annular recess in the housing of the pump 11, as may be seen generally at the right in FIG. 3.

As a drive for the pump 11, and especially as a drive for effecting the axial displacement of each piston 38, a preferably rotating contact surface 39 is provided. A plane of this piston end engaging, rotating contact surface 39 forms an opening angle $\alpha$ with the longitudinal axis of the shaft 02 which opening angle $\alpha$ is unequal to 90° and is also unequal to 180°.

The piston end engaging contact surface 39 is arranged so as to be tilted at an angle $\beta$ in relation to a vertical plane 41, for example, at an opening angle $\beta$ of 3° to 20°, as seen in FIG. 3. This contact surface 39 rotates with the roller shell 08 and is preferably connected to the roller shell 08 in a non-positive fashion, for example via a second clamp ring. As may be seen in FIG. 3, this second clamp ring is depicted schematically as two cooperating wedge rings that are situated in an annular recess formed in the outer periphery of the contact surface 39. This second clamp ring thus releasably secures the rotatable contact surface 39 to the inner surface of the cylindrical roller shell 08.

Figure 4:
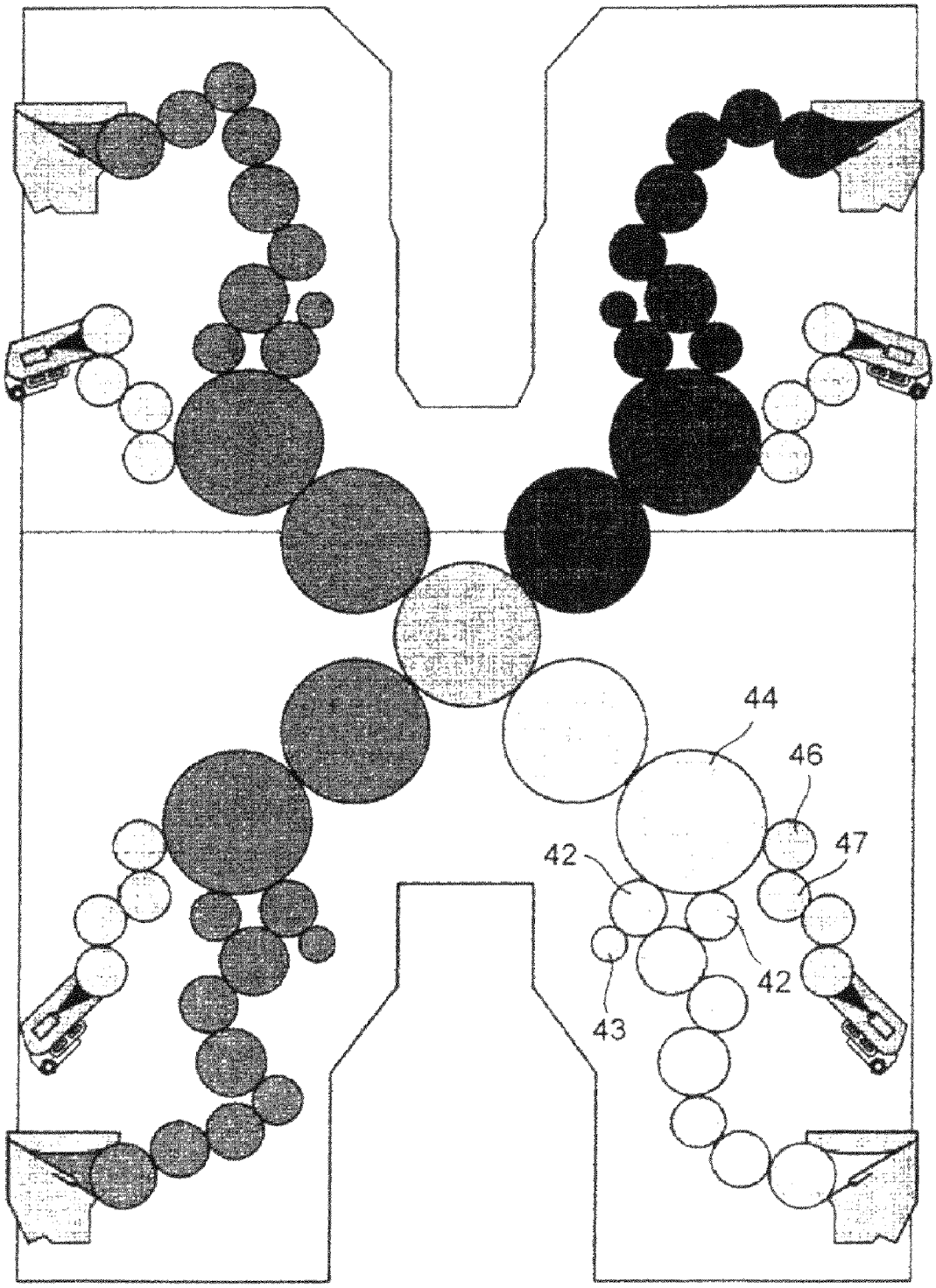

As is depicted schematically in FIG. 4, the axially oscillating roller 01 can be configured, for example, as an oscillating roller 43, which cooperates directly with an ink forme roller 42 of an inking system. The ink forme roller 42 and/or a dampening forme roller 46 of a corresponding dampening system are in direct contact with a forme cylinder 44. The axially oscillating roller 01 can also be configured as the ink forme roller 42 or as the dampening forme roller 46. It is also possible to configure the roller as an intermediate roller 47 of a dampening unit. This intermediate roller 47 preferably cooperates directly with the dampening forme roller 46.

The roller 01, and especially the roller shell 08 of the axially oscillating roller 01, is preferably driven by exclusively non-positive drive arrangements, such as, for example, by a roller or by a forme cylinder 44 that cooperates directly with the roller 01. The pump 11 may therefore be driven outside of, or separately from the roller 01, exclusively by the use of a non-positive drive, via the directly cooperating roller or the directly cooperating forme cylinder 44.

While preferred embodiments of a roller for a printing press and comprising a device for generating an axial oscillating movement of the rotating roller, in accordance with the present invention, have been set forth fully and completely hereinabove, it will be apparent to one of skill in the art that changes in, for example, the specific structure of the printing press with which the roller is intended for use, the type of ink or dampening agent being applied by the roller, and the like could be made without departing from the true spirit and scope of the present invention which is accordingly to be limited only by the appended claims.

What is claimed is:

1. A roller (01) for a printing press comprising:

a roller shaft;

a roller shell supported by said roller shaft for rotation about said roller shaft and for axial oscillating movement along said roller shaft;

a device within said roller shell and connected to said roller shell and to said roller shaft to generate said axial oscillating movement of said rotating roller shell; and a drive (11, 12, 14, 23) for said device to generate said axial oscillating movement of said rotating roller shell, said drive including a pump (11) which is usable to place a working fluid in said pump under a working pressure, said pump (11) being situated inside said rotating roller shell of said roller (01), said pump being driven by rotation of said rotating roller shell, said working fluid placed under pressure by said pump being provided by said pump to said drive and being usable, in said drive, to actuate said device for generating said axial oscillating movement of said rotating roller shell.

2. The roller according to claim 1, characterized in that the drive (11, 12, 14, 23) includes a drive wheel (12), which is driven by rotation of the rotating roller shell of the roller (01).

3. The roller according to claim 2, characterized in that the drive wheel (12) is one of non-positively and positively connected to the rotating roller (01).

4. The roller according to claim 2, characterized in that the drive wheel (12) is functionally connected to the rotating roller shell (08) of the roller (01).

5. The roller according to claim 2, characterized in that the drive wheel (12) is situated inside the roller (01).

6. The roller according to claim 2, characterized in that the pump (11) is connected to the drive wheel (12).

7. The roller according to claim 1, further including first and second pressure chambers for said working fluid (17; 18), which pressure chambers cause said drive to reversingly act in opposite axial directions of said roller shaft.

8. The roller according to claim 7, further including a switchover valve (23) in said drive.

9. The roller according to claim 7, characterized in that the first and second pressure chambers (17; 18) are situated inside the roller shell (08).

10. The roller according to claim 1, characterized in that the rotating roller shell (08) of the roller (01) is cylindrical.

11. The roller according to claim 1, wherein said device to operate said axial oscillating movement of said rotating roller shell includes a slide mechanism (04) which is mounted on the roller shaft (02) so as to be non-rotatable, and is displaceable in an axial direction of said roller shaft.

12. The roller according to claim 11, wherein the rotating roller shell (08) is rotatably mounted on the slide mechanism (04).

13. The roller according to claim 7, characterized in that the drive (11, 12, 14, 23) includes a cylinder/piston assembly (14).

14. The roller according to claim 13, characterized in that the cylinder/piston assembly (14) is situated inside the rotating roller shell of the roller (01).

15. The roller according to claim 8, characterized in that the switchover valve (23) comprises a movable switching section (24), which can be switched by engagement with at least one of a slide mechanism in said device to generate said oscillating movement of said rotating roller shell (04) and with an actuating element connected to said slide mechanism, and by engagement with the shaft (02) and by engagement with an actuating element connected to said shaft.

16. The roller according to claim 13, further including a slide mechanism in said drive and wherein the cylinder/piston assembly (14) operates between the roller shaft (02) and the slide mechanism (04).

17. The roller according to claim 16, characterized in that a cylinder (16) of the cylinder/piston assembly (14) is connected to the roller shaft (02), and a piston (19) of the cylinder/piston assembly (14) is connected to the slide mechanism (04).

18. The roller according to claim 13, characterized in that the cylinder/piston assembly (14) of the drive (11) is situated to generate an oscillating movement in an axial direction of a longitudinal axis of the roller (01).

19. The roller according to claim 1, characterized in that the pump (11) is configured as a piston pump having at least one piston (38).

20. The roller according to claim 19, characterized in that the piston pump is configured as an axial piston pump.

21. The roller according to claim 1, characterized in that the pump (11) is positioned so as to be non-rotatable in relation to the shaft (02).

22. The roller according to claim 1, characterized in that the pump device (11) is attached to the shaft (02).

23. The roller according to claim 7, characterized in that said working fluid can be supplied to the first and second pressure chambers (17; 18) in an alternating fashion by the pump (11).

24. The roller according to claim 13, wherein the first and second pressure chambers (17; 18) are formed by a dual-action cylinder (16) of the cylinder/piston assembly (14).

25. The roller according to claim 8, characterized in that the switchover valve (23) is configured for the alternating supply of working fluid to one or the other of the first and second pressure chambers (17 or 18).

26. The roller according to claim 8, characterized in that the switchover valve (23) is situated inside the roller shell (01).

27. The roller according to claim 8, characterized in that the switchover valve (23) is situated so as to be non-rotatable in relation to the shaft (02).

28. The roller according to claim 27, characterized in that the switchover valve (23) is attached to the shaft (02).

29. The roller according to claim 8, characterized in that the switchover valve (23) is switched in response to a relative axial movement between the shaft (02) and the roller shell (08).

30. The roller according to claim 8, characterized in that the switchover valve (23) has a device which prevents the placement of the switch and valve in a neutral position.

31. The roller according to claim 8, characterized in that the switchover valve (23) has a detent mechanism.

32. The roller according to claim 8, characterized in that the switchover valve (23) can be switched based upon the pressure existing in the first and second pressure chambers (17; 18).

33. The roller according to claim 1, characterized in that the working fluid is a hydraulic fluid.

34. The roller according to claim 33, characterized in that a reservoir (13) for said hydraulic fluid is provided.

35. The roller according to claim 34, further including a switchover valve and wherein the reservoir (13) is connected to the pump (11) by the switchover valve (23).

36. The roller according to claim 34, characterized in that the reservoir (13) is situated inside the roller (01).

37. The roller according to claim 36, characterized in that the reservoir (13) is situated so as to be non-rotatable in relation to the shaft (02).

38. The roller according to claim 37, characterized in that the reservoir (13) is attached to the shaft (02).

39. The roller according to claim 34, further including a housing for the pump and wherein the reservoir (13) shares the housing with the pump (11).

40. The roller according to claim 1, characterized in that the working fluid is a gas.

41. The roller according to claim 40, characterized in that the working fluid is air.

42. The roller according to claim 1, characterized in that the working fluid can be supplied to the pump in the roller (01) through at least one bore hole in the shaft (02).

43. The roller according to claim 1, characterized in that the roller (01) is an oscillating roller (01) of one of an inking unit and a dampening unit of the printing press.

44. The roller according to claim 1, characterized in that the pump (11) has a contact surface (39) which is tilted in relation to a vertical plane (41).

45. The roller according to claim 1, characterized in that the pump (11), which is situated inside the roller shell (08), is driven from outside of the roller shell (08).

46. The roller according to claim 1, characterized in that the drive (11, 12, 14, 23) is situated completely inside the roller shell (08).

* * * * *